United States Patent [19]

Fujita

[11] Patent Number: 5,039,551

[45] Date of Patent: Aug. 13, 1991

[54] METHOD OF MANUFACTURING A PHOSPHOR SCREEN OF A CATHODE RAY TUBE

[75] Inventor: Koji Fujita, Kanagawa, Japan

[73] Assignee: Sony Corporation, Tokyo, Japan

[21] Appl. No.: 378,025

[22] Filed: Jul. 1, 1989

[30] Foreign Application Priority Data

Jul. 15, 1988 [JP] Japan ..... 63-176435

[51] Int. Cl.[5] ..... B05D 5/06; B05D 5/12

[52] U.S. Cl. ..... 427/64; 427/68; 427/69; 427/73; 427/226; 427/250; 427/404; 427/407.1

[58] Field of Search ..... 427/64, 68, 69, 73, 427/250, 226, 248.1, 404, 407.1; 313/466, 467, 473

[56] References Cited

U.S. PATENT DOCUMENTS

| | | | |
|---|---|---|---|
| 4,018,717 | 4/1977 | Francel et al. | 252/513 |
| 4,122,213 | 10/1978 | Ito et al. | 427/64 |
| 4,284,662 | 8/1981 | Matsugaki et al. | 427/68 |
| 4,339,475 | 7/1982 | Hinosugi et al. | 427/64 |
| 4,590,092 | 5/1986 | Giancaterini et al. | 427/68 |

FOREIGN PATENT DOCUMENTS

| | | |
|---|---|---|
| 654673 | 6/1951 | United Kingdom . |
| 954042 | 4/1964 | United Kingdom . |
| 990854 | 5/1965 | United Kingdom . |
| 1223773 | 3/1971 | United Kingdom . |
| 1520859 | 8/1978 | United Kingdom . |
| 1520860 | 8/1978 | United Kingdom . |
| 1524545 | 9/1978 | United Kingdom . |

*Primary Examiner*—Michael Lusignan
*Assistant Examiner*—Roy V. King
*Attorney, Agent, or Firm*—Hill, Van Santen, Steadman & Simpson

[57] ABSTRACT

A method of manufacturing a phosphor screen of a cathode ray tube having processes of forming a phosphor material on an inner surface of a cathode ray tube, forming a first intermediate film on the phosphor material, forming a second intermediate film having a baking temperature different from that of the first intermediate film on an upper surface of the first intermediate film, forming a metal back layer on an upper surface of the second intermediate layer, and baking a product at a predetermined baking temperature. Also, a method of manufacturing a phosphor screen of a cathode ray tube is disclosed, which has processes of forming a phosphor material on an inner surface of a cathode ray tube, forming an organic acid film on the phosphor material, forming an intermediate film on an upper surface of the organic acid film, forming a metal back layer on an upper surface of the intermediate layer, and baking a product at a predetermined baking temperature.

9 Claims, 7 Drawing Sheets

METHOD OF MANUFACTURING A PHOSPHOR SCREEN OF A CATHODE RAY TUBE

BACKGROUND OF THE INVENTION

1. Field of the Invention

The present invention relates generally to a method of manufacturing a phosphor screen of a cathode ray tube. More particularly, this invention relates to a method of manufacturing an intermediate layer for a metal back layer.

2. Description of the Prior Art

As a method of manufacturing a phosphor screen of a color cathode ray tube, there is known a so-called PVA (polyvinyl alcohol) slurry method.

In order to understand the present invention more clearly, let us first explain this PVA slurry method with reference to process diagrams forming FIGS. 1A to 1F.

As shown in FIG. 1, a face plate 21 is prepared, and a light absorption layer, for example, a carbon stripe layer 20 is formed on the face plate 21. Ammonium bichromate is added to a polyvinyl alcohol solution and a phosphor is mixed into the resultant solution to form a so-called phosphor slurry 22. The phosphor slurry 22 is coated on the inner surface of the face plate 21, dried and is then exposed to light by using a color selection electrode (for example, aperture grille) as an optical mask (see FIG. 1A). After the exposure, the color selection electrode is removed and the product is developed by water, whereby the portion irradiated with light is left thereon to form a phosphor layer, for example, a phosphor stripe 23. The similar processes are repeatedly carried out to form a green phosphor stripe 23G, a blue phosphor stripe 23B and a red phosphor stripe 23R, sequentially (see FIG. 1B).

The product is then dried and is uniformly coated with an aqueous solution 24 containing an acrylic resin (for example, "PRIMAL", product name) as shown in FIG. 1C. Then, the product is again dried and an acrylic resin film, or an intermediate film 25 is formed on the phosphor stripe 23 as shown in FIG. 1D. Thereafter, a metal back layer 26 is formed on the intermediate layer 25 by an aluminum vapor deposition process (see FIG. 1E), and the whole of the product is baked to remove the intermediate layer 25 beneath the metal back layer 26. Thus, the process for manufacturing a phosphor screen is ended as shown in FIG. 1F.

The metal back layer 26 has a charge-up effect for the lowering of the surface potential of the phosphor screen by the bombardment of electrons from an electron gun or such an electrical effect that the surface potential of the phosphor screen is maintained to be an anode potential. Also, the metal back layer 26 has such an optical effect that a reflection coefficient is increased by using the aluminum thin film forming the metal back layer 26 as a mirror surface. Further, the metal back layer 26 has such an effect that can prevent ion spot from being produced when negative ion within the cathode ray tube strikes the phosphor screen, or the metal back layer 26 can prevent brightness of a phosphor screen from being deteriorated or the metal back layer 26 can increase the brightness of the phosphor screen. If the metal back layer 26 is smooth, then the above-mentioned effects become more remarkable. Therefore, it is proposed in the art that the metal back layer 26 is made smooth by forming the intermediate layer 25 on the phosphor stripe 23 prior to the aluminum vapor deposition process.

The prior-art method of manufacturing a phosphor screen of a cathode ray tube will be described more fully with reference to FIGS. 2A and 2B. As shown in FIG. 2A, when the acrylic resin solution 24 is coated on the phosphor stripe 23, the solution 24 is permeated into the phosphor materials 23*a*. If the product is dried under this condition, then the intermediate layer 25 is formed on the surface of the phosphor stripe 23 so as to fill in its concavities and convexities.

The intermediate layer 25 is, however, formed on the surface of the phosphor stripe 23 in accordance with the large concavities and convexities formed on the surface of the phosphor stripe 23. Consequently, the intermediate layer 25 itself is not formed smooth so that the metal back layer 26 formed on the intermediate layer 25 is not formed smooth, as shown in FIG. 2B. As a result, the effects inherent in the metal back layer 26 can not be demonstrated sufficiently.

In order to make the intermediate layer 25 more smooth, the film thickness of the intermediate layer 25 is increased by increasing a concentration of the acrylic resin in the solution, thereby filling in the concavities and convexities on the surface of the phosphor stripe 23. In this case, however, upon the baking-process, a relatively large amount of the intermediate layer 25 is sputtered and the metal back layer 26 formed on the intermediate layer 25 is raised, which provides a problem of a so-called expanded aluminum film (or floated aluminum film). This causes the brightness of the cathode ray tube to be deteriorated. For this reason, the film thickness of the intermediate layer 25 is limited, or the concentration of the acrylic resin in the solution is limited (the limit is generally about 30%). Thus, the intermediate layer having satisfactory smoothness can not be obtained.

In order to make the intermediate layer smooth, other methods are proposed. One of such previously-proposed methods is to form the intermediate layer by the use of acryl lacquer. This method, however, needs some special apparatus for spraying acryl lacquer on the phosphor material. Also, the acryl lacquer is an organic solvent and has to be treated with great care.

OBJECTS AND SUMMARY OF THE INVENTION

It is an object of the present invention to provide an improved method of manufacturing a phosphor screen of a cathode ray tube.

More specifically, it is an object of the present invention to provide a method of manufacturing a phosphor screen of a cathode ray tube in which effects inherent in a metal back layer can be demonstrated as much as possible.

It is another object of the present invention to provide a method of manufacturing a phosphor screen of a cathode ray tube, by which a brightness of a phosphor screen of a cathode ray tube can be considerably increased.

According to an aspect of the present invention, there is provided a method of manufacturing a phosphor screen of a cathode ray tube comprising the steps of:

(a) forming a phosphor material on an inner surface of a cathode ray tube;

(b) forming a first intermediate film on said phosphor material;

(c) forming a second intermediate film having a baking temperature different from that of said first intermediate film on an upper surface of said first intermediate film;
(d) forming a metal back layer on an upper surface of said second intermediate layer; and
(e) baking a product.

According to another aspect of the present invention, there is provided a method of manufacturing a phosphor screen of a cathode ray tube comprising the steps of:
(1) forming a phosphor material on an inner surface of a cathode ray tube;
(2) forming an organic acid film on said phosphor material;
(3) forming an intermediate film on an upper surface of said organic acid film;
(4) forming a metal back layer on an upper surface of said intermediate layer; and
(5) baking a product.

These and other objects, features and advantages of the present invention will be apparent in the following detailed description of a preferred embodiment of the invention when read in conjunction with the accompanying drawings, in which like reference numerals are used to represent the same or similar parts in the several views.

BRIEF DESCRIPTION OF THE DRAWINGS

FIGS. 3A to 30 are process diagrams of an embodiment of a method of manufacturing a phosphor screen of a cathode ray tube according to the present invention, respectively.

DETAILED DESCRIPTION OF A PREFERRED EMBODIMENT

An embodiment of a method of manufacturing a phosphor screen of a cathode ray tube according to the present invention will now be described in detail with reference to FIGS. 3A to 30 and FIGS. 4A to 4G.

FIGS. 3A to 30 are, respectively, process diagrams of a method of manufacturing a phosphor screen of a cathode ray tube according to the present invention. The respective processes will be explained hereinunder in the sequential order.

Figure 1A:
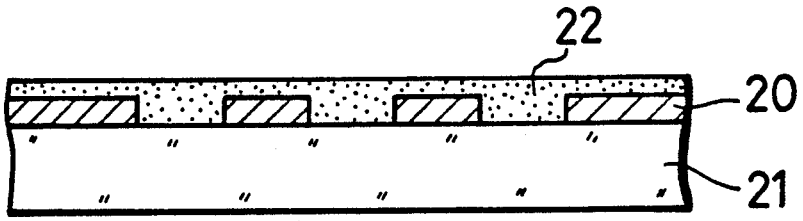
FIG. 1A (PRIOR ART)
FIGS. 1A to 1F are process diagrams used to explain an example of a prior-art method of manufacturing a phosphor screen of a cathode ray tube, respectively.
Figure 1B:
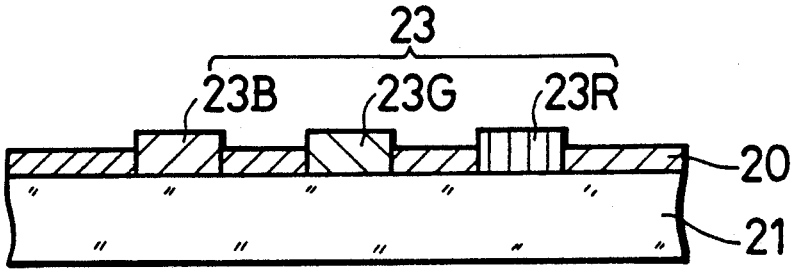
FIG. 1B (PRIOR ART)
Figure 1C:
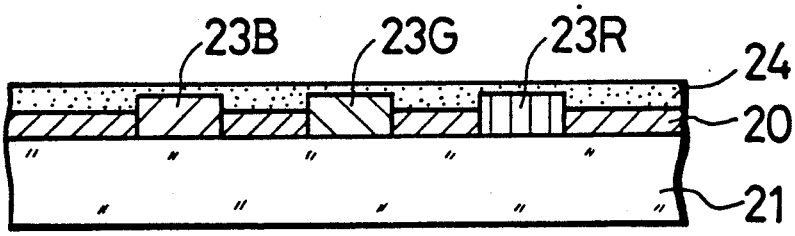
FIG. 1C (PRIOR ART)
Figure 1D:
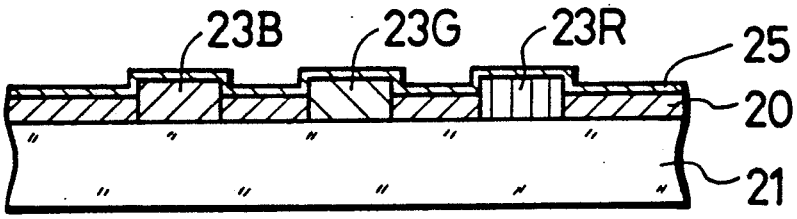
FIG. 1D (PRIOR ART)
Figure 1E:
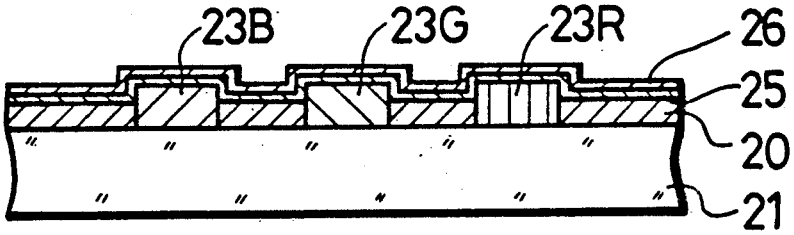
FIG. 1E (PRIOR ART)
Figure 1F:
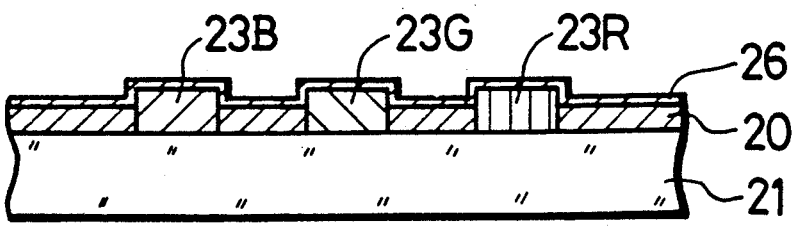
FIG. 1F (PRIOR ART)
Figure 2A:
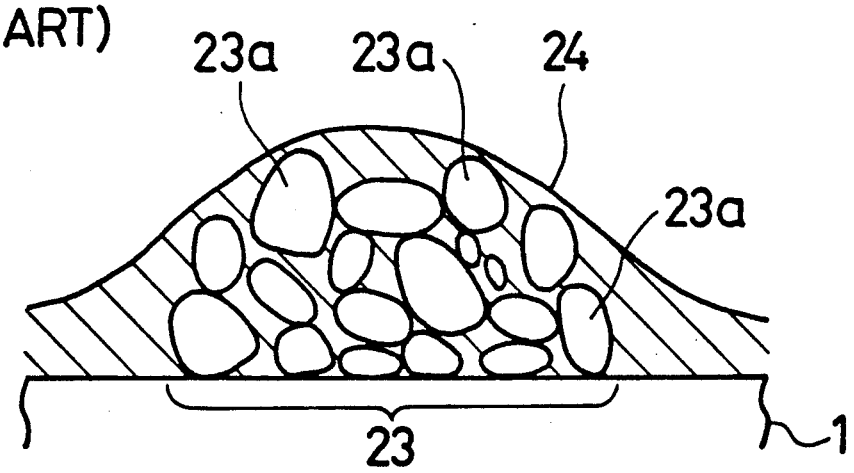
FIG. 2A (PRIOR ART)
FIGS. 2A and 2B are schematic diagrams used to explain the action of the intermediate layer used in the example of the prior art, respectively.
Figure 2B:
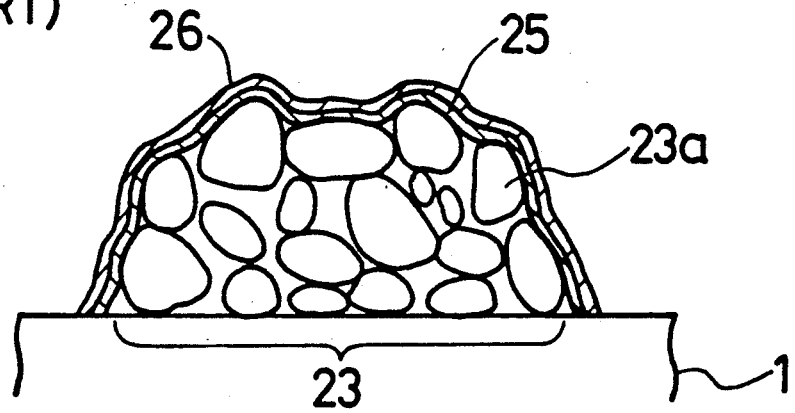
FIG. 2B (PRIOR ART)
Figure 3A:
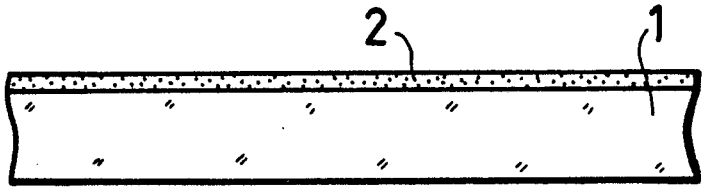
Figure 3B:
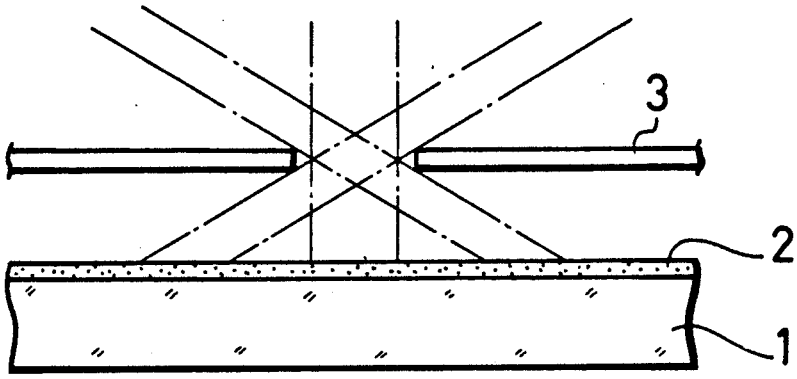
Figure 3C:
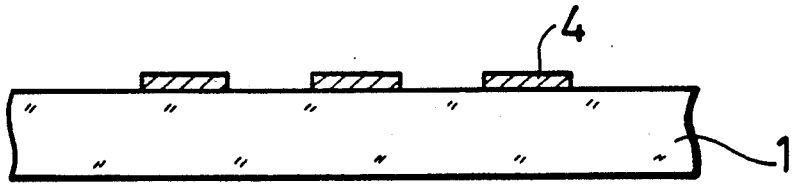
Figure 3D:
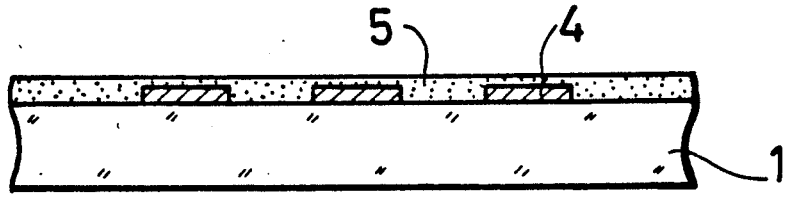
Figure 3E:
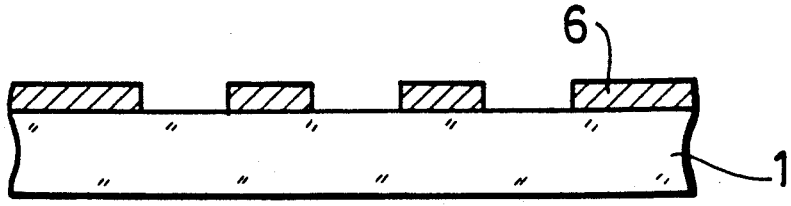
Figure 3F:
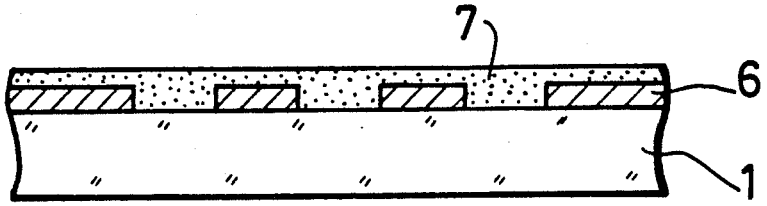
Figure 3G:
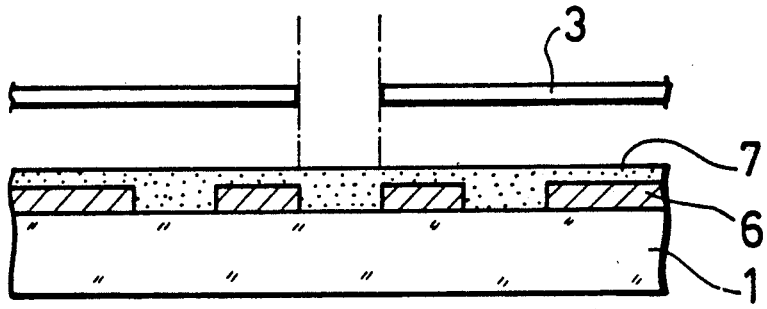
Figure 3H:
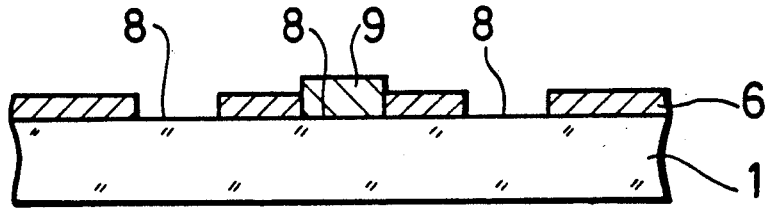
Figure 3I:
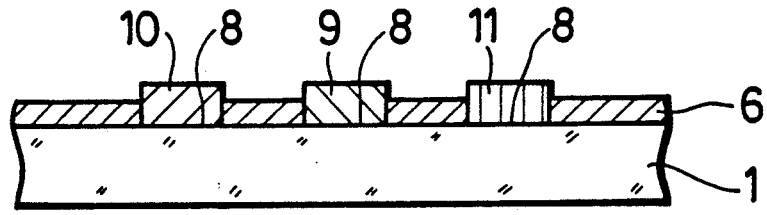

Initially, as shown in FIG. 3A, a PVA photosensitive film 2 is formed on the inner surface of a face plate 1 of a cathode ray tube by means of the coating-process. After the drying-process, the product is exposed to ultraviolet rays through a predetermined optical mask (for example, aperture grille or the like) 3 as shown in FIG. 3B. After the exposing-process, the product is rinsed by water and is developed to form PVA stripes 4 on the face plate 1 at positions corresponding to respective colors (for example, green, blue and red) as shown in FIG. 3C. Then, a carbon slurry 5 is coated on the whole surface of the face plate 1 including the PVA stripes 4 as shown in FIG. 3D. After the drying-process, the PVA stripes 4 and the carbon layer formed thereon are removed together by a so-called lift-off process, thereby forming a carbon stripe of a predetermined pattern, or a black stripe 6 as shown in FIG. 3E. Thereafter, a green phosphor slurry 7, for example, is coated on the whole surface of the face plate 1 including the black stripe 6 as shown in FIG. 3F. The product is then dried and is exposed to the light through the optical mask (aperture grille) 3 (see FIG. 3G). After the exposing-process, the product is rinsed by water and developed to form a green phosphor stripe 9 on a so-called blank portion 8 formed between the predetermined carbon stripes 6 as shown in FIG. 3H. Then, the similar processes are repeatedly carried out to form blue and red phosphor stripes 10 and 11 on other blank portions 8 as shown in FIG. 3I.

Figure 3J:
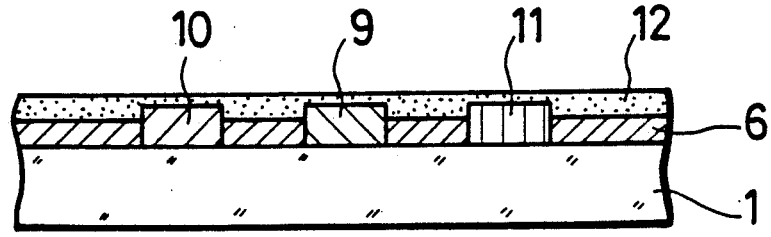
Figure 3K:
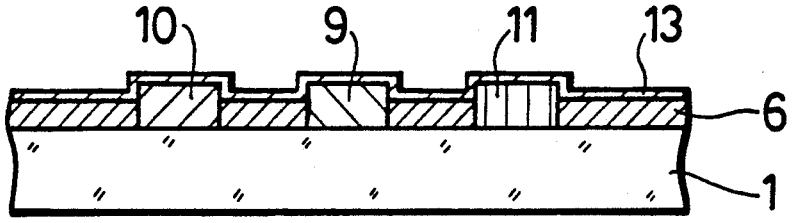
Figure 3L:
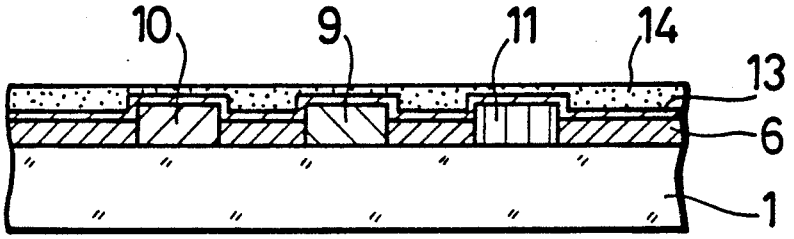
Figure 3M:
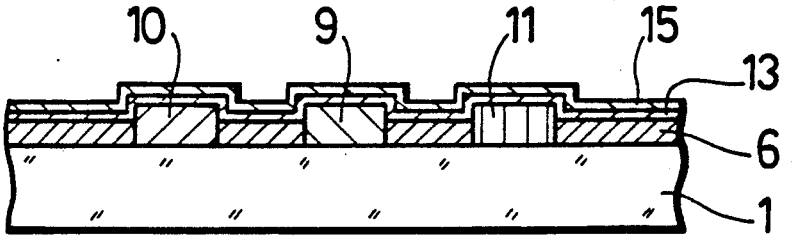
Figure 3N:
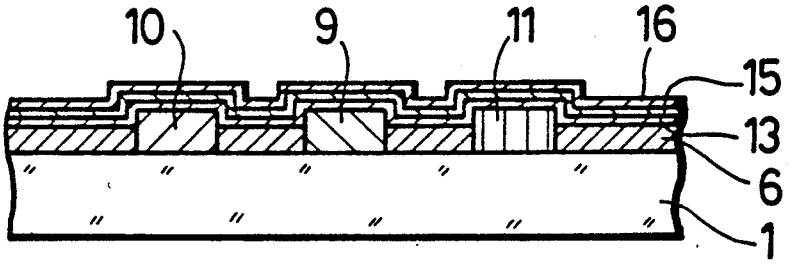
Figure 3O:
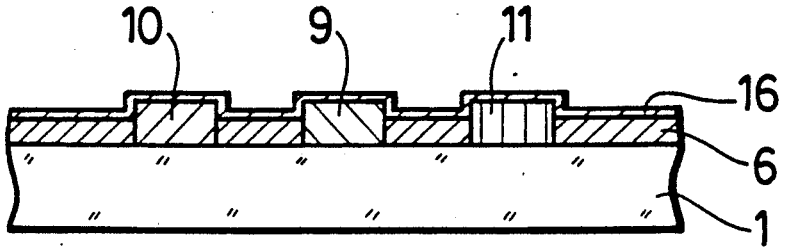

An aqueous solution 12 containing 1% to 3% of citric acid is uniformly coated on the whole surface including these phosphor stripes 9, 10 and 11 as shown in FIG. 3J, and is dried to form a citric acid layer 13 (see FIG. 3K). A solution of 30% of acrylic resin, for example, PRIMAL B-74 (product name) or 30% of PRIMAL C-72 (product name) and 70% of water are mixed to form a solution 14. This solution 14 is uniformly coated on the citric acid layer 13 (see FIG. 3L) and is again dried to form an acrylic resin-based intermediate film 15 on the citric acid film 13 (see FIG. 3M). Thereafter, an aluminum film is formed on the intermediate film 15 by the vacuum deposition-process, and this aluminum film is served as a metal back layer 16 (see FIG. 3N). Then, the whole of the product is baked at 430° C., whereby the citric acid film 13 and the intermediate film 15 beneath the metal back layer 16 are removed, thus the processes for manufacturing a phosphor screen according to this embodiment being ended (see FIG. 30).

Let us next explain the individual stages for manufacturing the citric acid film 13, the acrylic resin-based intermediate film 15 and the metal back layer 16 in detail with reference to FIGS. 4A to 4G. In FIGS. 4A to 4G, like parts corresponding to those of FIGS. 3A to 30 are marked with the same references and thererfore need not be described in detail.

Also, only the stage for manufacturing the above films and the metal back layer on the green phosphor stripe 9 will be described for simplicity and the stages for manufacturing the films and the metal back layer on the blue and red phosphor stripes 10 and 11 are not described herein since they can be formed similarly.

Figure 4A:
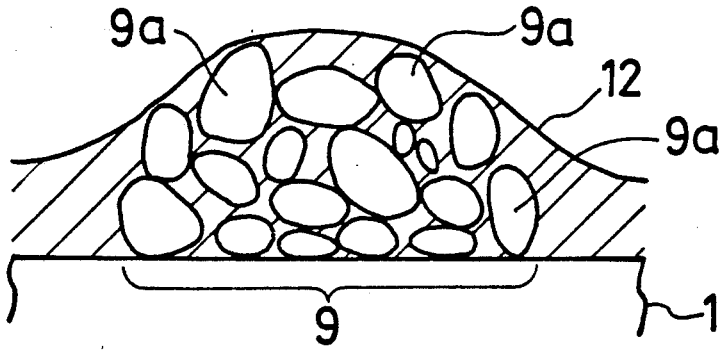
FIGS. 4A to 4G are schematic diagrams used to explain the action of the citric acid layer used in the present invention, respectively.
Figure 4B:
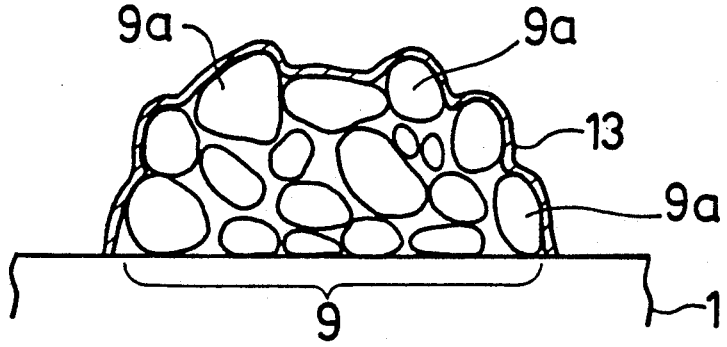
Figure 4C:
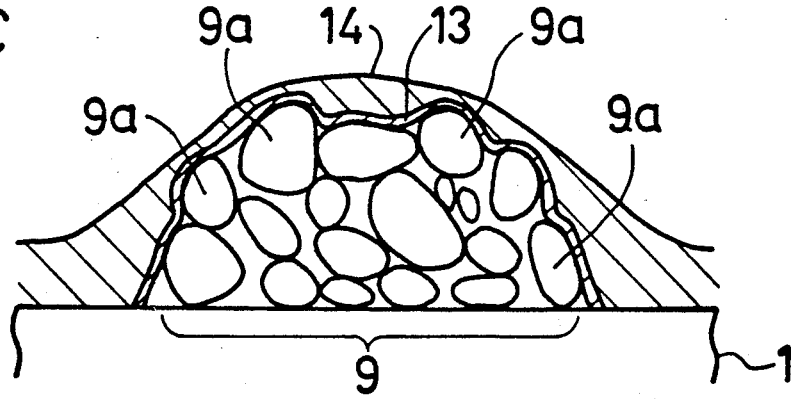
Figure 4D:
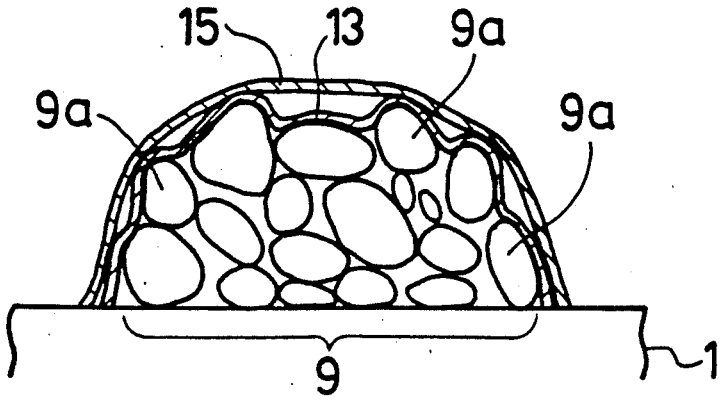

When the citric acid aqueous solution 12 is coated on the phosphor stripe 9, this aqueous solution 12 is permeated into spaces among fluorescent or phosphor materials **9*a* as shown in FIG. 4A. When the product is dried under this condition, the thin citric acid film 13 is formed on the surface of the phosphor stripe 9 in accordance with the concavities and convexities of the surface as shown in FIG. 4B. Thereafter, the acrylic resin-based solution 14 is coated on the citric acid film 13 as shown in FIG. 4C. In this case, the acrylic resin-based solution 14 is inhibited from entering the spaces among the phosphor materials 9*a* by the citric acid film 13 and is coated only on the citric acid flim 13 as a thin film. Further, the acrylic-based resin in the solution 14 is repelled by the citric acid film 13. When the product is dried under this condition, the acrylic resin-based solution 14 is formed as a film so that the so-called intermediate film 15 is formed so as to link the concavity and convexity on the surface where the concavities and convexities are remarkable. Thus, on the whole, a smooth film is formed over the concavities and convexities of the surface of the phosphor stripe 9 as shown in FIG. 4D. Even if the concentration of the acryl-based resin in the acrylic resin-based solution 14 is increased to form the intermediate film, only the thin, smooth film is formed on the citric acid film 13 and on the surface of the phosphor stripe 9 similarly as described above. Accordingly, when the acryl resin-based solution 14** is formed of acryl-based resin and water, it is possible to increase the concentration of the acryl-based resin.

Figure 4E:
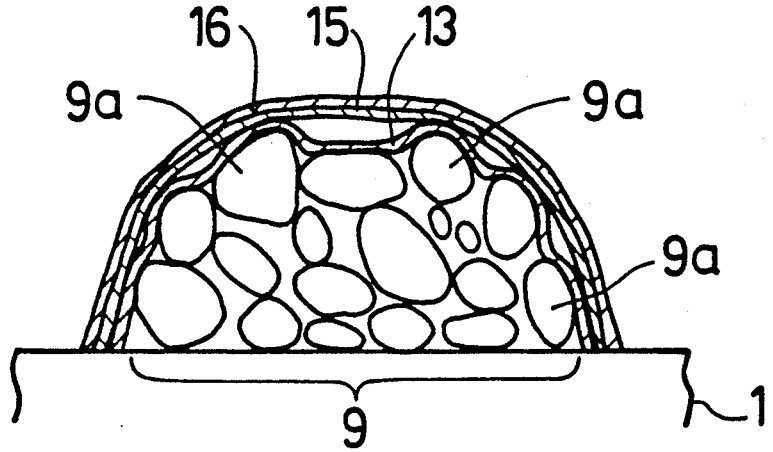
Figure 4F:
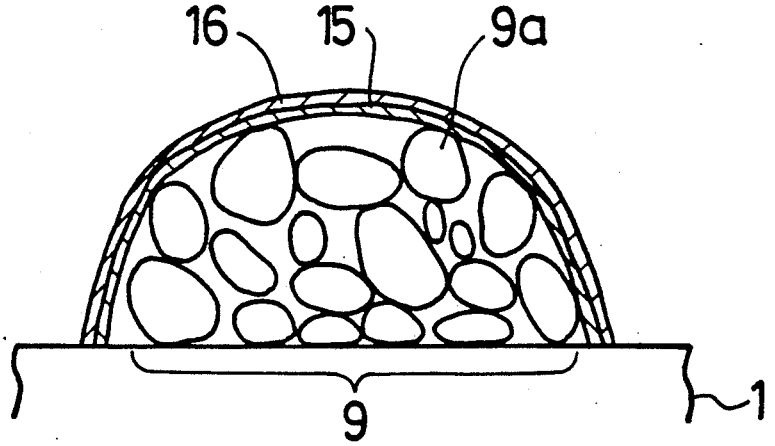
Figure 4G:
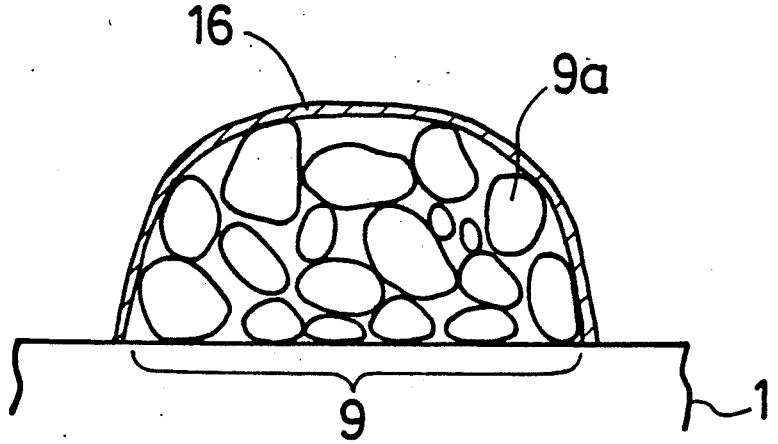

When the metal back layer 16 is formed by the aluminum vapor deposition-process under this condition, the smooth metal back layer 16 is formed as shown in FIG. 4E. Thereafter, when the product is baked at 430° C., the citric acid film 13 and the acryl resin-based intermediate film 15 formed beneath the metal back layer 16 are removed and the phosphor stripe 9 and the metal back layer 16 are finally left over as shown in FIG. 4G through the condition shown in FIG. 4F.

The actions and effects of the citric acid film 13 and the acryl resin-based intermediate film 15 in the baking-process will be described next.

The baking temperature of the citric acid film 13 is about 200° C. and the baking temperature of the acryl resin-based intermediate film 15 is about 400° C.

In the baking-process, the temperature is gradually increased. Near the baking temperature of 200° C., the citric acid film 13 is baked first as shown in FIGS. 4E and 4F. When the citric acid film 13 is baked, the metal back layer 16 keeps its smoothness without being pushed up by evaporated components of the citric acid film 13.

When the baking temperature reaches 430° C., the acryl resin-based intermediate film 15 is baked as shown in FIGS. 4F and 4G. Similarly to the citric acid film 13, this intermediate film 15 has a standard thickness substantially equal to the prior-art intermediate film so that when the intermediate film 15 is baked, the metal back layer 16 keeps its smoothness without being pushed up by the evaporated components of the intermediate layer 15.

Although the films 13 and 15 form a double-layer structure and have thicknesses larger than the ordinary thickness, the baking temperatures of these films 13 and 15 are different. Thus, in the baking-process, the films 13 and 15 are not baked at the same time but they are baked one by one at two steps. Hence, the metal back layer 16 can be protected from being pushed up or swollen.

While in the above-mentioned embodiment the citric acid aqueous solution 12 is an aqueous solution to which 1% to 3% of citric acid, it is possible to use a citric acid ammonium aqueous solution in which ammonium is added to the above-mentioned aqueous solution 12 to provide pH 6 to 7 (neutral). In this case, the aqueous solution is neutral so that regardless of the employment of acid phosphor material or alkaline phosphor material, the manufacturing-process of the phosphor screen is not affected. Further, regardless of the employment of acid or alkaline intermediate layer, the manufacturing-process of the phosphor screen is not affected so that the manufacturing-process of the present invention is excellent in selection property and is suitable for various purposes.

While in the above-mentioned embodiment the citric acid film 13 is formed prior to the coating-process of the acrylic resin-based solution 14 which forms the acrylic resin-based intermediate film 15 after the water-developing-process for forming the phosphor stripes 9, 10 and 11, it is possible that the citric acid film 13 is formed after the water-developing-process and the drying-process. In this case, however, with the increase of the drying-process, the manufacturing efficiency is deteriorated, and also the coating condition of the citric acid aqueous solution 12 tends to be irregular. It is therefore desirable that the citric acid aqueous solution 12 is coated after the water-developing-process without being subjected to the drying-process as in the above-mentioned embodiment.

While in the above-mentioned embodiment citric acid is employed, it is possible to use other acids such as acetic acid and the like.

As described above, according to the method of manufacturing a phosphor screen of a cathode ray tube according to the present invention, since the citric acid film 13 is formed before the acrylic resin-based intermediate film 15 is formed, the intermediate film 15 is formed thin on the citric acid film 13. The intermediate layer 15 is made thin so as to link the concavities and convexities on the surfaces of the phosphor stripes 9, 10 and 11 by the repelling action of the citric acid film 13 against the intermediate layer 15. In accordance therewith, the metal back layer 16 becomes smooth. Further, since the baking temperature of the citric acid film 13 is different from that of the intermediate layer 15, in the baking-process, these films 13 and 15 are not baked at the same time but they are individually baked stepwise. Thus, the metal back layer 16 can be prevented from being swollen and the metal back layer 16 can be kept smooth. Accordingly, the effects inherent in the metal back layer 16 can be demonstrated as much as possible and hence, the brightness of the phosphor screen of the cathode ray tube thus made can be increased.

Further, since the coating-process of the citric acid aqueous solution 12 is effected after the water-developing-process but without being subjected to the drying-process, the coating condition can be prevented from becoming irregular. Also, the number of the respective processes is substantially the same as that of the prior art. Furthermore, since the citric acid is inexpensive and can be treated with ease, the manufacturing method of the present invention is excellent in working efficiency and is inexpensive from a money standpoint.

In addition, since the intermediate film 15 is formed on the citric acid film 13, it becomes possible to use the intermediate layer 15 which contains acrylic resin of higher concentration. Thus, the intermediate layer 15 can be made more smooth.

According to the method of manufacturing a phosphor screen of a cathode ray tube by the present invention, as set forth above, after the phosphor material is formed on the inner surface of the cathode ray tube, the first intermediate film is formed on the phosphor material and then the second intermediate film having the baking temperature different from that of the first intermediate film is formed on the first intermediate film. Then, the metal back layer formed by the aluminum vapor deposition-process is formed on the upper surface of the second intermediate film and thereafter the product is then baked on the whole. Therefore, although the intermediate film has the double-layer structure and has the large thickness, in the baking-process, the metal back layer can be prevented from being swollen. Simultaneously, since the intermediate film is formed to have the double-layer structure, the intermediate film more smooth than the prior-art intermediate layer can be formed. Hence, the brightness of the phosphor screen of the cathode ray tube can be increased.

Further, according to the method of manufacturing a phosphor screen of a cathode ray tube by the present invention, after the phosphor material is formed on the inner surface of the cathode ray tube, the organic acid film is formed on the phosphor material and then the intermediate film is then formed on the organic acid film. After the metal back layer formed by the aluminum vapor deposition-process is formed on the upper surface of the intermediate film, the product is baked so that due to the fact that the organic acid film can be prevented from entering the phosphor material by the citric acid film and also that the intermediate film can be repelled by the citric acid film, the intermediate film can be made smooth, whereby the metal back layer can also be made smooth. Therefore, it is possible to increase the brightness of the phosphor screen of the cathode ray tube.

It should be undestood that the above description is presented by way of example on a single preferred embodiment of the invention and it will be apparent that many modifications and variations thereof could be effected by one with ordinary skill in the art without departing from the spirit and scope of the novel concepts of the invention so that the scope of the invention should be determined only by the appended claims.

I claim as my invention:

1. A method of manufacturing a phosphor screen of a cathode ray tube consisting of the steps of:

(a) forming a phosphor material on an inner surface of a cathode ray tube;

(b) forming a first intermediate film on said phosphor material by applying an aqueous solution containing 1% to 3% citric acid, said film having a baking temperature of about 200° C.;

(c) forming a second intermediate film having a baking temperature of about 400° C., on an upper surface of said first intermediate film, said second intermediate film being an acrylic resin-based film;

(d) forming a metal back layer on an upper surface of said second intermediate film; and (e) baking the coated tube at a predetermined temperature to remove the first and second intermediate films in succession.

2. The method according to claim 1, wherein said predetermined baking temperature is about 430°.

3. A method of manufacturing a phosphor screen of a cathode ray tube consisting of the steps of:

(a) forming a phosphor material on an inner surface of a cathode ray tube;

(b) forming a citric acid film having a baking temperature of about 200° C. on said phosphor material;

(c) forming an acrylic resin-based intermediate film having a baking temperature of about 400° C. on an upper surface of said citric acid film;

(d) forming a metal back layer on an upper surface of said intermediate film; and then (e) baking the coated the coated tube to remove the citric acid film and the intermediate film in succession.

4. The method according to claim 3, wherein said baking step is performed at a predetermined baking temperature.

5. The method according to claim 4, wherein said predetermined baking temperature is about 430° C.

6. A method according to claim 1, wherein the step of forming the metal back film comprises vapor depositing aluminum on the second intermediate layer.

7. A method according to claim 6, wherein the predetermined baking temperature is about 430° C.

8. A method according to claim 5, wherein the step of forming the metal back layer comprises vapor depositing aluminum onto the upper surface.

9. A method according to claim 3, wherein the step of forming the metal back layer comprises vapor depositing aluminum on said upper surface.

* * * * *